US006146095A

United States Patent [19]

Bross et al.

[11] Patent Number: 6,146,095

[45] Date of Patent: Nov. 14, 2000

[54] SPIRAL HOUSING PUMP

[75] Inventors: Stephan Bross, Erpolzheim; Peter Hergt, Ludwigshafen, both of Germany

[73] Assignee: KSB Aktiengesellschaft, Frankenthal, Germany

[21] Appl. No.: 09/153,233

[22] Filed: Sep. 15, 1998

[30] Foreign Application Priority Data

Sep. 15, 1997 [DE] Germany ..... 197 40 590

[51] Int. Cl.[7] ..... F04D 29/44

[52] U.S. Cl. ..... 415/204; 415/163; 415/207

[58] Field of Search ..... 415/163, 164, 415/185, 186, 191, 203, 204, 206, 207, 208.2, 208.3, 211.2; 29/888.024

[56] References Cited

U.S. PATENT DOCUMENTS

| | | | |
|---|---|---|---|
| 2,399,548 | 4/1946 | Ingersoll . | |
| 2,955,540 | 10/1960 | Pawlicki . | |
| 3,289,598 | 12/1966 | Buse et al. . | |
| 4,406,583 | 9/1983 | Becker et al. | 415/219 C |
| 4,729,715 | 3/1988 | Wilde | 415/150 |

FOREIGN PATENT DOCUMENTS

| | | | |
|---|---|---|---|
| 323 504 | 3/1903 | France . | |
| 1 076 154 | 10/1954 | France . | |
| 2 138 832 | 2/1972 | Germany . | |
| 3001598 | 7/1981 | Germany | 415/204 |
| 219 739 | 6/1942 | Switzerland . | |
| 623006 | 7/1978 | U.S.S.R. | 415/206 |

OTHER PUBLICATIONS

Blom, Carl, "Development of the Hydraulic Design for the Grand Coulee Pumps", Transactions of the ASME, Jan. 1950, pp. 53–70.

KSB Kreiselpumpenlexikon, 3rd Edition, 1989, pp. 242–243.

Blom, Carl, "Development of the Hydraulic Design for the Grand Coulee Pumps" Transactions of the ASME, Los Angeles, California, Jan. 1950, pp. 53–70.

*Primary Examiner*—Edward K. Look
*Assistant Examiner*—Liam McDowell
*Attorney, Agent, or Firm*—Evenson, McKeown, Edwards & Lenahan, P.L.L.C.

[57] ABSTRACT

A housing for a double spiral circulation pump includes a spiral housing and a multipartite rib. The spiral housing defines a flow channel. The multipartite rib is disposed in the housing to divide the flow channel. The multipartite rib includes at least two rib parts spaced from each other to define a gap therebetween.

17 Claims, 3 Drawing Sheets

SPIRAL HOUSING PUMP

BACKGROUND OF THE INVENTION

The invention relates to a centrifugal pump having a double spiral housing including a rib configured as a dividing wall.

In centrifugal pumps there is known to be a hydraulic radial force produced by the interaction of the impeller and the pump housing. Such radial forces are subject to various influences, such as those described for example in KSB-Kreiselpumpenlexikon, 3rd Edition, 1989, pages 242 and 243. Single spiral housing pumps have in the design point along the impeller circumference a virtually constant pressure or velocity distribution. At this point a spiral housing pump can be operated virtually free of radial force. If, however, a spiral housing pump is operated at partial load or overload due to changed conditions of operation, this leads to increasing radial forces due to varying pressure or velocity distributions along the impeller circumference.

This disadvantage has led to the development of double spiral housings in which the radial forces are maintained at a low level over the entire operating range. Such double spiral housings, also known as twin volute pumps, are disclosed, for example by U.S. Pat. No. 2,955,540 to Pawlicki, and U.S. Pat. No. 3,289,598 to Buse et al., the disclosures of which are expressly incorporated by reference herein. A double spiral housing includes two spiral halves offset by 180° in which a fluid flowing from the impeller is collected and fed to a common discharge connection. Due to the quasi mirror-image arrangement of the two spiral halves, an approximately symmetrical pressure distribution develops along one impeller circumference, whose resultant components of force cancel one another. A double spiral housing is created by inserting into a single spiral housing a so-called "rib" as a dividing wall which, as seen in the direction of impeller rotation forms a second half spiral beginning about 180° from a lip of the housing. The side of the rib facing away from the impeller, the rear side, defines a diversion channel through which a fluid that has collected in the first spiral half is guided to the discharge connection.

The manufacturing of double spiral housings is technically complex and expensive, since the long housing cores necessary for casting are troublesome to secure so that they will not float up during the casting process. After the casting is complete the removal of the cores presents considerable difficulty in cleaning up the casting. For this purpose, additional holes are often provided in the pump housing wall, but it is difficult to weld those holes shut so as to withstand pressure. Despite these measures, the hard-to-reach areas of the double spiral housing allow only an incomplete surface treatment, the consequence of which is a loss of efficiency. To avoid these disadvantages, it is known from Pawlicki, U.S. Pat. No. 2,955,540, to make the rib as a separate part and insert it afterward into a cast spiral housing. This does facilitate machining the surface to dress the casting, but also requires a great amount of work in the production of a double spiral housing, so that there is no cost advantage.

For this reason much research has been conducted toward a critical study of the geometry of the ribs of double spiral housings and to examine their radial force curves. It is known, for example, from Buse et al., U.S. Pat. No. 3,289,598, to vary the length of the rib and the loop angle of the rib to obtain a change in the radial force curve. In FIG. 7 of U.S. Pat. No. 3,289,598, the radial force curves of various length ribs are shown. The shorter ribs achieve only an insignificant improvement in manufacture over the longer ribs; however, the shorter ribs disadvantageously increase the radial forces in the partial-load and overload ranges as compared with the longer ribs.

SUMMARY OF THE INVENTION

It is an object of the invention to provide an improved double spiral pump housing of the kind referred to above.

Another object of the invention is to provide a double spiral pump housing which is relatively simple to manufacture, especially by casting.

A further object of the invention is to provide a double spiral pump housing which maintains radial forces at a low level over the entire operating range.

These and other objects have been achieved according to the present invention by providing a housing for a double spiral centrifugal pump, including a spiral housing defining a flow channel; and a multipartite rib disposed in the housing to divide the flow channel, the multipartite rib including at least two rib parts spaced from each other to define at least one gap therebetween.

It is also an object of the invention to provide an improved method of manufacturing a double spiral pump housing.

These and other objects have been achieved according to the present invention by providing a method of manufacturing a housing for a double spiral centrifugal pump, the method comprising the act of forming a spiral housing defining a flow channel with a multipartite rib disposed in the housing to divide the flow channel, the rib including at least two rib parts spaced from each other to define a gap therebetween.

The problems of the prior art double spiral pump housings are overcome by the present invention by making the rib in at least two parts, i.e., at least bipartite, with gaps between its parts. This permits problem-free production of a double spiral housing with a cross section that can be freely designed. The known spiral cross sections, e.g. rectangular, trapezoidal, pear-shaped, etc., can easily be produced. Making the rib a multipartite component including at least two rib parts located a distance apart from each other and defining a gap therebetween permits a simple placement of the rib parts within the spirals and evens out the pressure distribution along the impeller circumference. Furthermore, an improved radial force curve is thereby achieved in comparison with a single spiral housing. Thus, the radial force in the entire load range of the pump can be reduced. The arrangement of the rib parts at a distance apart creates a gap between them so that the complex additional supports for a casting core can be dispensed with. This has the advantage that it makes the paths of flow near the rib parts much easier to reach when cleaning up the casting.

According to certain preferred embodiments of the invention, accessibility can be further improved if the edge of the rib part located nearest a lip in the housing defining a discharge passageway is disposed at a distance from said lip to define a gap therebetween. This improves accessibility to the flow passages created thereby in the area of the rib parts forming the double spiral, for example for removal of casting cores and/or for cleaning an/or surface treatment of those areas after casting.

According to certain preferred embodiments of the invention, the loop angle $\phi$ of a rib part in relation to the number n of the rib parts used is in the range of $$0.7 \cdot \frac{360°}{2 \cdot n} \leq \varphi \leq 1.1 \cdot \frac{360°}{2 \cdot n} \quad (1)$$

Thus, the rib parts used may have identical lengths, or the rib parts may have different lengths.

According to certain preferred embodiments of the invention, the angle $\tau$ between the housing lip defining the discharge conduit and the upstream edge of the first rib part in the direction of flow is in the range of $$0.8 \cdot \frac{360°}{n} \leq \tau \leq \frac{360°}{n} \cdot 1.2 \quad (2)$$

It is then sufficient that the distance and position of the rib parts in relation to one another is adjusted so that access to the passages defined by the rib parts is assured by the gaps existing between the rib parts and between the housing lip and the rib part nearest the housing lip. For this purpose the distance between the edges of the rib parts is adjusted such that sufficiently large gaps will defined between the rib parts. According to certain preferred embodiments, the angle $\Delta\tau$ between an upstream edge of one of the rib parts having a loop angle $\phi$ and an adjacent downstream one of the rib parts is within the range of $$0.8 \cdot \phi \leqq \Delta\tau \leqq 1.5 \cdot \phi \quad (3)$$

The profiles of the rib parts can be of identical or different shape. Since $\Delta\tau$ is a measure between upstream edges of adjacent rib parts, independent of the length of the ribs, the length of the ribs does not influence the above equation. According to certain preferred embodiments, it has proven advantageous toward a further reduction of the radial forces if the upstream edges of the rib parts are disposed on circles with the diameter $D_r$, whose ratios to the impeller diameter $D_2$ are in the range of $$1.03 \leq \frac{D_r}{D_2} \leq 1.15 \quad (4)$$

The diameters $D_r$ on which the upstream edges of the individual rib parts are located need not be identical; instead the upstream edges of the rib parts can be located on different diameters.

According to certain preferred embodiments of the invention, the radial forces are advantageously also reduced by disposing the upstream edge of one of the rib parts on a smaller diameter than the end of a rib part situated upstream thereof. The spiral housing is, of course, so configured that the channel defined by a rib part does not hamper or disadvantageously affect the exit of the fluid from the first spiral part.

The profile of the rib parts is subject to no limitations. For example, the rib parts may have a constant thickness or may have a non-constant thickness distribution. Likewise, the rib parts may have different shapes. Such configuration of a rib provides for a very easy production of a double spiral housing by casting. At the same time it offers the advantage that such rib parts can also easily be added on afterward. It is also contemplated to arrange the rib parts adjustably, e.g., pivotably mounted on the housing. Depending on how the shaft is arranged on the double-rib part, the angle of attack of the double-rib part can be varied with respect to the flow issuing from the impeller.

A positive effect on the reduction of the radial force is also obtained by making the cross-sectional area in the first quadrant of the double spiral housing downstream of the housing lip defining the discharge passage larger than a typical spiral development.

According to the present invention using at least two rib parts, a radial force curve can be achieved that will correspond approximately to the radial force curve of a conventional double spiral housing. The slight differences between the radial force curve of the present invention and that of a conventional double spiral housing are negligible. Furthermore, the advantages achievable by the simpler production of the instant invention far outweigh any differences in the radial force curve.

BRIEF DESCRIPTION OF THE DRAWINGS

The invention will be explained in further detail with reference to illustrative embodiments depicted in the accompanying drawings in which.

DETAILED DESCRIPTION OF PREFERRED EMBODIMENTS

Figure 1:
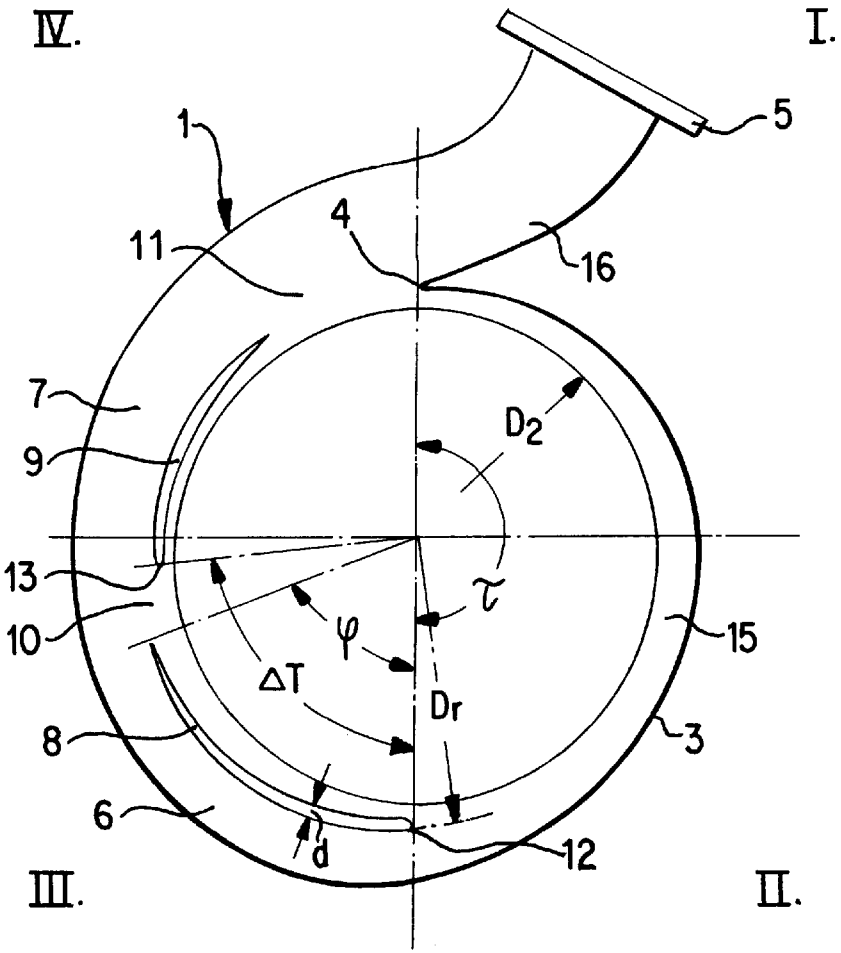
FIG. 1 is a perspective view of a double spiral pump housing having a multipartite rib according to the present invention.
Figure 2:
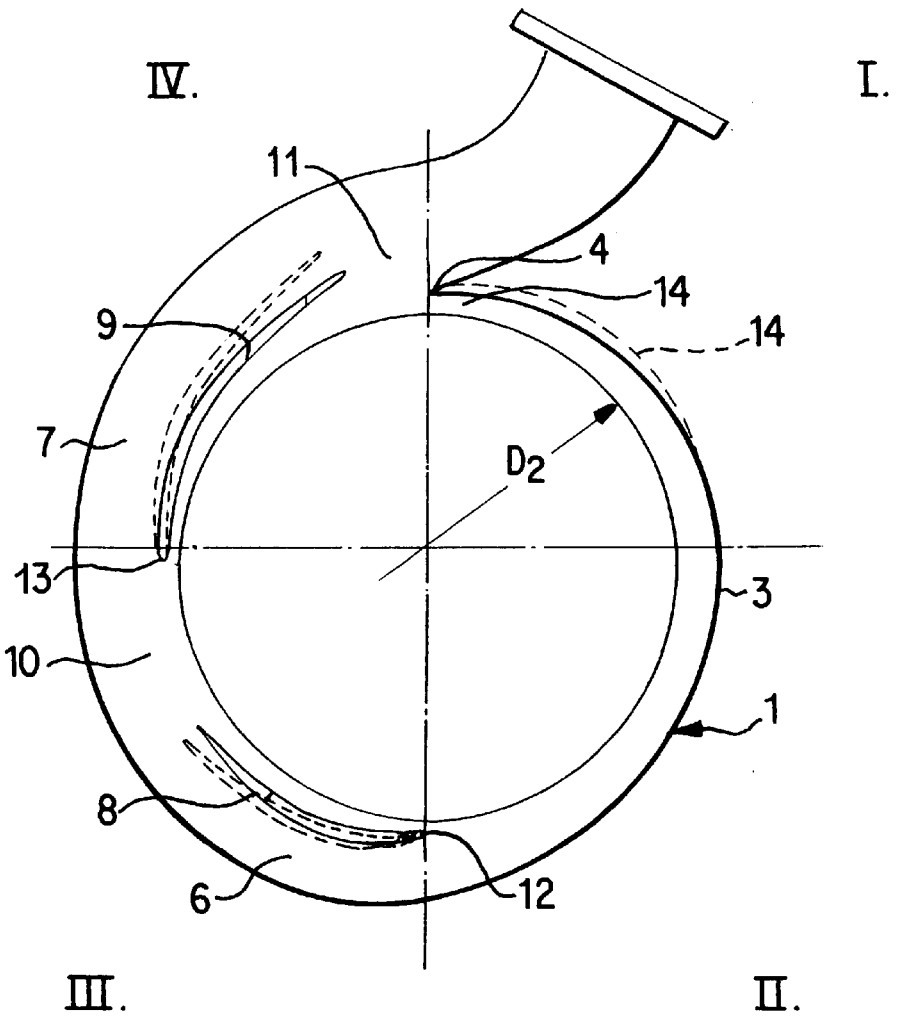
FIG. 2 is a perspective view of a double spiral pump housing having a multipartite rib according to another embodiment of the present invention.
Figure 3:
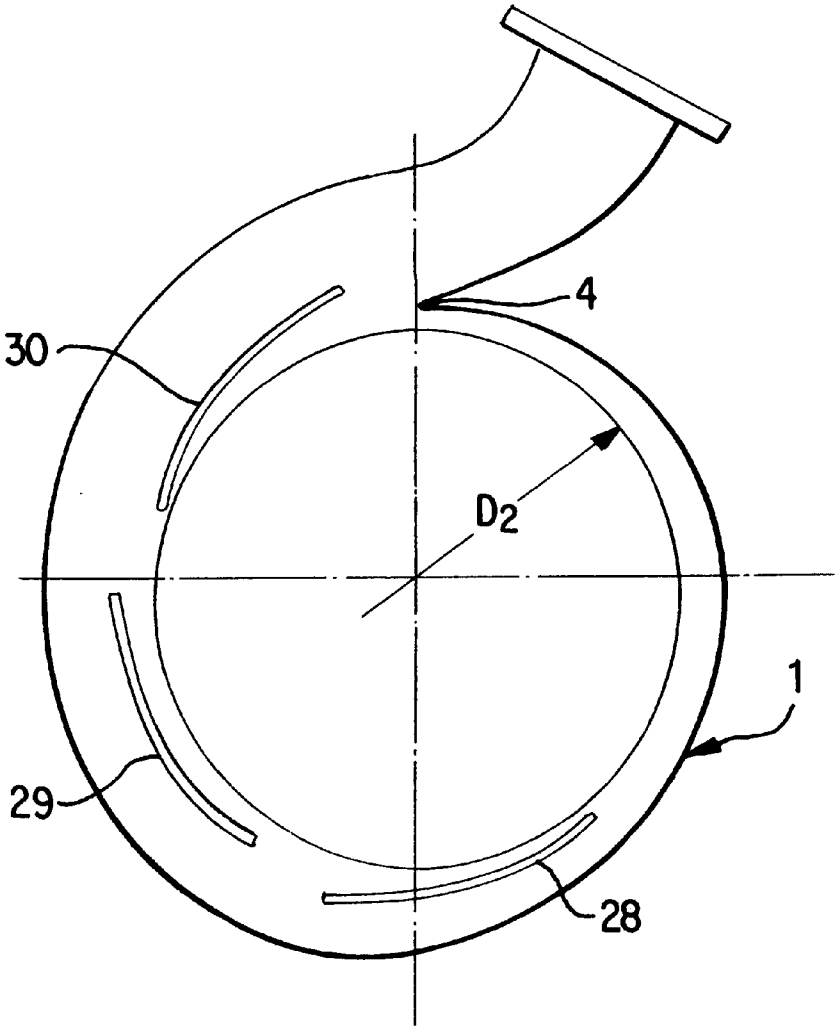
FIG. 3 is a perspective view of a double spiral pump housing having a multipartite rib according to another embodiment of the present invention.

Referring to FIGS. 1–3, a housing 1 of a centrifugal pump has an impeller with an outside diameter $D_2$. The housing 1 is configured as a double spiral housing, defining a fluid flow channel 15. The first portion 3 of the spiral starts at the lip 4 of the housing defining a discharge passageway 16 and extends clockwise therefrom. The housing lip 4 defines the beginning of the first quadrant I, in which the discharge connection 5 is situated. The first spiral portion 3 has an increasing enlargement of cross section in the clockwise direction from the housing lip 4, which in the embodiment of FIG. 1 reaches its maximum at the end of the second quadrant II (i.e., 180° from the housing lip 4). From this point the fluid is driven through a bypass 6, 7, to the discharge connection 5. The bypass 6, 7, is defined by the wall of the housing 1 as well as by the wall of the rib parts 8 and 9.

The rib parts 8 and 9 form the other or second spiral portion, in a manner similar to a double spiral housing, dividing the fluid flow channel 15. A gap 10 between the adjacent rib parts 8 and 9 (i.e., between the downstream end of the first rib part 8 and the upstream end of the second rib part 9), as well as a gap 11 between the housing lip 4 and the downstream end of the rib part 9, allow access to the passages 6 and 7 during production of the housing. Thus, for example, in the case of a cast housing, a housing core used therein can be more easily removed and the casting surface can be more easily cleaned up. Furthermore, the fluid flow surfaces within the pump housing can be treated or worked to achieve a desired surface finish in order to improve the efficiency of the pump.

The rib parts may have a constant cross-sectional thickness d, for example as shown by rib parts 28, 29, 30 in FIG. 3, or the rib parts may have a varying cross-sectional thickness d, as shown by rib parts 8, 9 in FIGS. 1 and 2.

Furthermore, the cross-sectional profiles of the various rib parts 8, 9 may be identical to each other, or may be different from each other, in cross-sectional thickness and/or in angular length. In the embodiment of FIG. 1, the first rib part 8 is longer than the second rib part 9. The upstream edge 12 of the first rib part 8 is located at an angle $\tau$ from the housing lip 5, in the direction of flow. The angle $\tau$ is determined according to the following formula (formula (2) above), where n=the number of rib parts:

$$0.8\cdot\frac{360^\circ}{n}\leq\tau\leq\frac{360^\circ}{n}\cdot 1.2.$$

The loop angle $\phi$ of the rib parts 8, 9 is determined according to the following formula (formula (1) above), where n=the number of rib parts:

$$0.7\cdot\frac{360^\circ}{2\cdot n}\leq\varphi\leq 1.1\cdot\frac{360^\circ}{2\cdot n}.$$

As noted above, the radial lengths, i.e. the loop angles $\phi$, of the various rib parts 8, 9 need not be identical.

The space $\Delta\tau$ shown in FIG. 1 between the upstream edges 12 and 13 of the rib parts 8 and 9 is determined according to the following formula (formula (3) above), where $\phi$=the loop angle of the first rib part 8:

$$0.8\cdot\phi\leqq\Delta\tau\leqq 1.5\cdot\phi.$$

According to certain preferred embodiments, the angle $\Delta\tau$ between an upstream edge of one of the rib parts having a loop angle $\phi$ and an adjacent downstream one of the rib parts is within the range of $\phi<\Delta\tau\leqq 1.5\cdot\phi$, in order to provide better accessibility to the divided flow passages, for example for removal of casting cores and/or for cleaning an/or surface treatment of those areas after casting.

The upstream edges 12 and 13 of rib parts 8 and 9 lie on circles with diameters $D_r$ whose ratios to the impeller diameter $D_2$ are determined according to the following formula (formula (4) above):

$$1.03\leq\frac{D_r}{D_2}\leq 1.15.$$

FIG. 2 shows the rib parts 8 and 9 in a different kind of arrangement than FIG. 1. The first rib part 8 disposed in the 3rd quadrant III of housing 1 is shorter in length, while the second rib part 9 in the 4th quadrant IV is greater in length. A positive influence on lowering the radial force is also provided by adjusting the first portion of the spiral in the first quadrant I of housing 1. The spiral cross section is enlarged (i.e., radially outwardly) in area 14 shown by a broken line, to a greater extent than in a typical spiral pump. Also, the housing lip 4 is at a greater distance from the outside diameter $D_2$ of the impeller than in the embodiment of FIG. 1. The cross-sectional enlargement 14 in the first quadrant of the spiral housing, and the position of the rib parts 8 and 9 in relation to one another and to the housing lip 4 is adapted to the hydraulics of the particular application of a impeller and the particular spiral shape. Thus radial force reductions can be achieved which correspond to the radial force characteristic of a traditional double spiral configuration. The radial force characteristic can also be influenced by varying the position of the upstream edges 12 and 13, as well as the shape and the size of the rib parts 8 and 9. Furthermore, the rib parts 8, 9 may be disposed adjustably on the housing 1, for example by mounting them pivotably about their upstream edges 12, 13 on the housing. In that way, the angle of attack of the double-rib part can be varied with respect to the flow issuing from the impeller.

In the embodiment of FIG. 3, all three rib parts 28, 29, 30 have the same length (i.e., the same loop angle $\phi$). Furthermore, the rib parts 28, 29, 30 have an essentially constant cross-sectional thickness d.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A housing for a double spiral centrifugal pump, comprising:

a spiral housing defining a flow channel; and a multi-part rib disposed in said housing to divide said flow channel, said rib including at least two rib parts spaced from each other to define at least one gap therebetween, said housing including a housing lip defining an outlet passage, one of said at least two rib parts located nearest said housing lip being disposed at a distance from said housing lip to define a gap therebetween, and said at least two rib parts consisting of a number n of said rib parts, wherein an angle $\tau$ between said housing lip and an upstream edge of a first one of said rib parts in a direction of flow is in the range of $$0.8\cdot\frac{360^\circ}{n}\leq\tau\leq\frac{360^\circ}{n}\cdot 1.2.$$

2. A housing according to claim 1, wherein said at least two rib parts consist of a number n of said rib parts, and wherein a loop angle $\phi$ of said rib parts is in the range of $$0.7\cdot\frac{360^\circ}{2\cdot n}\leq\varphi\leq 1.1\cdot\frac{360^\circ}{2\cdot n}.$$

3. A housing according to claim 2, wherein said housing includes a housing lip defining an outlet passage, and wherein an angle $\tau$ between said housing lip and an upstream edge of a first one of said rib parts in a direction of flow is in the range of $$0.8\cdot\frac{360^\circ}{n}\leq\tau\leq\frac{360^\circ}{n}\cdot 1.2.$$

4. A housing according to claim 1, wherein said at least two rib parts consist of a number n of said rib parts, and wherein an angle $\Delta\tau$ between an upstream edge one of said rib parts having a loop angle $\phi$ and an upstream edge of an adjacent downstream one of said rib parts is in the range of $$0.8\cdot\phi\leqq\Delta\tau\leqq 1.5\cdot\phi.$$

5. A housing according to claim 4, wherein said angle $\Delta\tau$ is in the range of $$\phi < \Delta\tau \leqq 1.5 \cdot \phi.$$

6. A housing according to claim 2, wherein an angle $\Delta\tau$ between an upstream edge one of said rib parts having a loop angle $\phi$ and an upstream edge of an adjacent downstream one of said rib parts is in the range of $$0.8 \cdot \phi \leqq \Delta\tau \leqq 1.5 \cdot \phi.$$

7. A housing according to claim 1, wherein an angle $\Delta\tau$ between an upstream edge one of said rib parts having a loop angle $\phi$ and an upstream edge of an adjacent downstream one of said rib parts is in the range of $$0.8 \cdot \phi \leqq \Delta\tau \leqq 1.5 \cdot \phi.$$

8. A housing according to claim 3, wherein an angle $\Delta\tau$ between an upstream edge one of said rib parts having a loop angle $\phi$ and an upstream edge of an adjacent downstream one of said rib parts is in the range of $$0.8 \cdot \phi \leqq \Delta\tau \leqq 1.5 \cdot \phi.$$

9. A housing according to claim 1, wherein upstream edges of said at least two rib parts are disposed on circles of equal or different diameters $D_r$, wherein an impeller for the pump has an impeller diameter $D_2$, and wherein a ratio of the diameters $D_r$ to said impeller diameter $D_2$ is in the range of $$1.03 \leq \frac{D_r}{D_2} \leq 1.15.$$

10. A housing according to claim 2, wherein upstream edges of said at least two rib parts are disposed on circles of equal or different diameters $D_r$, wherein an impeller for the pump has an impeller diameter $D_2$, and wherein a ratio of the diameters $D_r$ to said impeller diameter $D_2$ is in the range of $$1.03 \leq \frac{D_r}{D_2} \leq 1.15.$$

11. A housing according to claim 4, wherein upstream edges of said at least two rib parts are disposed on circles of equal or different diameters $D_r$, wherein an impeller for the pump has an impeller diameter $D_2$, and wherein a ratio of the diameters $D_r$ to said impeller diameter $D_2$ is in the range of $$1.03 \leq \frac{D_r}{D_2} \leq 1.15.$$

12. A housing according to claim 1, wherein an upstream edge of one of said rib parts is disposed on a smaller diameter than an end of one of said rib parts situated downstream.

13. A housing for a double spiral centrifugal pump, comprising:

a spiral housing defining a flow channel; and a multi-part rib disposed in said housing to divide said flow channel, said rib including at least two rib parts spaced from each other to define at least one gap therebetween, wherein the rib parts are disposed adjustably in the double spiral housing.

14. A housing according to claim 1, wherein said housing includes a housing lip defining an outlet passage, and wherein in a first quadrant of the housing in a downstream direction from said housing lip, said housing has a cross-sectional area enlargement.

15. A housing according to claim 1, wherein said housing is made by casting.

16. A method of manufacturing a housing for a double spiral circulation pump, said method comprising the act of forming a spiral housing defining a flow channel with a multipartite rib disposed in said housing to divide said flow channel, said rib including at least two rib parts spaced from each other to define a gap therebetween.

17. A method according to claim 16, wherein said forming act comprises casting.

* * * * *